US006626100B2

(12) United States Patent
Adner

(10) Patent No.: US 6,626,100 B2
(45) Date of Patent: Sep. 30, 2003

(54) APPARATUS AND METHOD FOR A GENERIC INK CUP

(75) Inventor: Ben Adner, Swampscott, MA (US)

(73) Assignee: Inkcups Now, Swampscott, MA (US)

( * ) Notice: Subject to any disclaimer, the term of this patent is extended or adjusted under 35 U.S.C. 154(b) by 0 days.

(21) Appl. No.: 09/681,958

(22) Filed: Jun. 29, 2001

(65) Prior Publication Data

US 2002/0152903 A1 Oct. 24, 2002

Related U.S. Application Data

(60) Provisional application No. 60/284,745, filed on Apr. 18, 2001.

(51) Int. Cl.[7] ..... B41F 17/00
(52) U.S. Cl. ..... 101/163; 101/35; 101/169
(58) Field of Search ..... 101/35, 41–44, 101/163, 167, 169, 170, 150

(56) References Cited

U.S. PATENT DOCUMENTS 3,742,902 A * 7/1973 Heston, Jr. ..... 101/124
4,557,195 A * 12/1985 Phlipp ..... 101/163
5,003,872 A * 4/1991 Dalferth ..... 101/163
5,237,922 A 8/1993 Ho ..... 101/333
5,272,972 A * 12/1993 Tobita ..... 101/163
5,272,973 A * 12/1993 Chojnacki ..... 101/163
5,320,037 A * 6/1994 Harris ..... 101/163
5,537,921 A * 7/1996 Adner et al. ..... 101/35
5,662,041 A * 9/1997 Kleist ..... 101/163
5,664,496 A * 9/1997 Scheuhing et al. ..... 101/163
5,694,847 A * 12/1997 Kleist ..... 101/169
5,746,129 A * 5/1998 Murray ..... 101/163
5,806,419 A * 9/1998 Adner et al. ..... 101/163
5,893,326 A 4/1999 Wong ..... 101/170
6,129,012 A 10/2000 Dietz et al. ..... 101/41

* cited by examiner

*Primary Examiner*—Andrew H. Hirshfeld
*Assistant Examiner*—Dave A. Ghatt
(74) *Attorney, Agent, or Firm*—Bromberg & Sunstein LLP

(57) ABSTRACT

A universal ink cup for a pad printing machine. The universal ink cup includes a first cup having walls defining a reservoir for holding liquid. An engageable coupling is removably coupled to the first cup, for affixing the ink cup to the pad printing machine. The engageable coupling may include a second cup, with the first cup including walls defining a hole such that the engageable coupling can be inserted in the hole and affixed to the first cup.

41 Claims, 5 Drawing Sheets

APPARATUS AND METHOD FOR A GENERIC INK CUP

CROSS REFERENCE TO RELATED APPLICATIONS

This application claims priority from U.S. provisional patent application serial No. 60/284,745, filed Apr. 18, 2001, entitled Apparatus and Method for a Generic Ink Cup, which is incorporated by reference, in its entirety.

TECHNICAL FIELD AND BACKGROUND OF INVENTION

The invention relates to an ink cup used as an inking and wiping device on pad transfer printing machines, and more specifically to a generic ink cup.

An ink cup 1 for an internal centering pin holddown machine is shown in FIG. 1. The internal centering pin holddown machine affixes the cup to the machine by a spring plunger that enters a recessed hole 6 at the top of the cup 1 and bottoms at the base of the hole. Pressure applied by the spring plunger, or air cylinder, presses the ink cup 1 against the printing plate and helps wipe the printing plate clean. Additionally, the ink cup may contain additional recessed holes 7, 8 for placing magnets 4, 5 such that additional pressure is applied. These magnets 4, 5 are permanently attached to the ink cup 1, typically by glue. This type of ink cup typically has a one-piece cup body 9 and usually has a two-sided, easily removable doctoring ring 2.

An ink cup 20 for an external holddown machine is shown in FIG. 2. An external holddown machine, part of which is shown in part 22, affixes the cup 20 to the machine by applying downward pressure on an outside flange 25 located on the outside circumference of the ink cup. These cups generally have no magnets as they do not need assistance for downward pressure, and have a one piece cup body, with the flange 25 being integral to the cup 20. The doctoring ring 23 is generally one sided and either is difficult to remove or cannot be removed without destroying the cup 20. An ink plug 21 allows for filling the cup with ink without removing the ink cup 20 from the printing plate, and also allows one to vent the cup 20 in case of pressure build up within the cup 20.

The ink cup designs for both the external and internal holddown machines are not adaptable and do not permit much flexibility in how the ink cups may be used. For example, if a printing operation has various types of external holddown machines that require the outside flanges to be different shapes, size or height, completely different ink cups would be required by each machine, even though they may be the same size and may be used to print the same image. Similarly, if a printing operation has various type of internal centering pin machines that require different centering pin diameters or lengths, completely different ink cups would be required by each machine, even though they may be the same size and may be used to print the same image.

Machine owners need spare ink cups on hand in the event that an ink cup is damaged and also to speed ink changeover. If a print job requires that a logo change color from green to blue, the best and fastest way to make that changeover is to have a filled, spare ink cup ready to be put in the machine. Otherwise, the ink cup must be removed and completely cleaned, which is very time consuming, before being filled with the new color and put back in to the machine. Therefore, the printing operation typically is required to stock multiple ink cups for each type of holddown machines in use, adding to the total number of ink cups required. This places a burden on supply and maintenance, adding additional costs.

SUMMARY OF INVENTION

In accordance with one embodiment of the invention, a universal ink cup for a pad printing machine is presented. The ink cup includes a first cup having walls defining a reservoir for holding liquid, and an engageable coupling, removably coupled to the first cup, for affixing the ink cup to the pad printing machine.

In related embodiments of the invention, the engageable coupling includes a second cup. The first cup may include walls defining a hole such that the engageable coupling can be inserted in the hole and affixed to the first cup. The first cup and/or the engageable coupling may have threads for affixing the first cup to the engageable coupling.

In other related embodiments, the engageable coupling includes various walls for serving a variety of purposes. The walls may define a centering pin receptor such that a centering pin of the pad printing machine can be inserted into the centering pin receptor, so as to affix the universal ink cup to the pad printing machine. In other embodiments, the walls define a cavity such that a magnet can be inserted into the cavity. The magnet applies a magnetic force so as to press the ink cup against a printing plate. The walls may also define a cavity for inserting a spanner wrench, or a cavity for inserting an antirotation pin.

In still other related embodiments, an external flange is coupled to the first cup. Pressure may be applied to the external flange to accommodate ink cup mounting, or in other embodiments, the external flange may be utilized to simply affix the pad printing machine to the universal ink cup. The external flange may be removably coupled to the first cup. The universal ink cup may include means for bolting or screwing the external flange to the first cup, or the external flange may include threads for affixing the external flange to the first cup. Additionally, the first cup may include a support shoulder such that an exterior hold-down flange can be dropped onto the shoulder.

In other related embodiments, a doctoring ring is coupled to the first cup. The doctoring ring may be removably coupled to the first cup and may have two working edges. The universal ink cup may also include an ink plug removably coupled to the first cup.

In yet more related embodiments, the first cup, engageable coupling, or doctoring ring may be formed of material selected from the group of materials consisting of ceramics, metals, alloys, and polymers. The first cup may have an outer perimeter with a diameter range between 30 and 250 mm, and may have an outer perimeter defining a shape selected from the group of shapes consisting of a circle, oval, and polygon.

In another embodiment of the invention, a universal ink cup for a pad printing machine is presented that includes a first cup having walls defining a reservoir for holding liquid, and an external flange removably coupled to the first cup. Pressure may be applied to the flange to accommodate ink cup mounting, or in other various embodiments, the external flange may be utilized to simply affix the pad printing machine to the universal ink cup. In related embodiments of the invention, the first cup includes a support shoulder such that the flange is affixed to the first cup by dropping the flange onto the shoulder. The external flange may include threads for engaging the first cup. The universal ink cup may include means for bolting or screwing the external flange to the first cup.

In other related embodiments of the invention, the universal ink cup includes a doctoring ring coupled to the first cup. The doctoring ring may be removably coupled to the first cup, and may have two working edges.

In still other related embodiments of the invention, the universal ink cup may include an ink plug removably coupled to the first cup for performing at least one operation from the group of operations consisting of adding ink to the first cup and venting the first cup. The first cup and/or doctoring ring may be formed of material selected from the group of materials consisting of ceramics, metals, alloys, and polymers. The first cup may have an outer perimeter defining a circle with diameter range between 30 and 250 mm, and may have an outer perimeter defining a shape selected from the group of shapes consisting of a circle, oval, and polygon.

In another related embodiment of the invention, the universal ink cup may include an engageable coupling coupled to the first cup, for affixing the universal ink cup to a pad printing machine. The engageable coupling may include a second cup, and/or may be removably coupled to the first cup.

The engageable coupling may include various types of walls for serving a variety of purposes. The walls may define a cavity such that a centering pin of the pad printing machine can be inserted into the cavity so as to affix the universal ink cup to the pad printing machine. Alternatively, the walls may define a cavity for inserting a magnet, the magnet for applying a magnetic force so as to press the ink cup against a printing plate.

In accordance with another embodiment of the invention, a method for applying a liquid to a depression in a plate is presented. The method includes providing a cup having walls defining a reservoir for holding liquid and providing a first engageable coupling removably coupled to the cup. The cup is affixed to a first pad printing machine via the first engageable coupling. The plate is contacted with the cup, wherein pressure supplied by the first pad printing machine seals the cup against the plate.

In related embodiments of the invention, the cup is moved across the plate. The cup may be integrated with a solvent feeding system, or a liquid viscosity maintenance system.

In another related embodiment of the invention, the method further includes detaching the cup from the first pad printing machine. The first engageable coupling is removed from the cup. A second engageable coupling removably coupled to the cup is provided. The cup is affixed to a second pad printing machine via the second engageable coupling The plate is contacted with the cup, wherein pressure supplied by the second pad printing machine seals the cup against the plate.

In accordance with yet another embodiment of the invention, a method for applying a liquid to a depression in a plate includes providing a cup having walls defining a reservoir for holding liquid and providing a first external flange removably coupled to the first cup, the first external flange being non-magnetic. The cup is affixed to a first pad printing machine via the first external flange. The plate is contacted with the cup.

In related embodiments of the invention, the cup is moved across the plate. The cup may be integrated with a solvent feeding system, or a liquid viscosity maintenance system.

In another related embodiment of the invention, the method further includes detaching the cup from the first pad printing machine and removing the first external flange from the cup. A second external flange removably coupled to the cup is provided, the second external flange being non-magnetic. The cup is affixed to a second pad printing machine via the second external flange. The plate is contacted with the cup.

BRIEF DESCRIPTION OF DRAWINGS

The foregoing features of the invention will be more readily understood by reference to the following detailed description, taken with reference to the accompanying drawings, in which.

DETAILED DESCRIPTION

Figure 1:
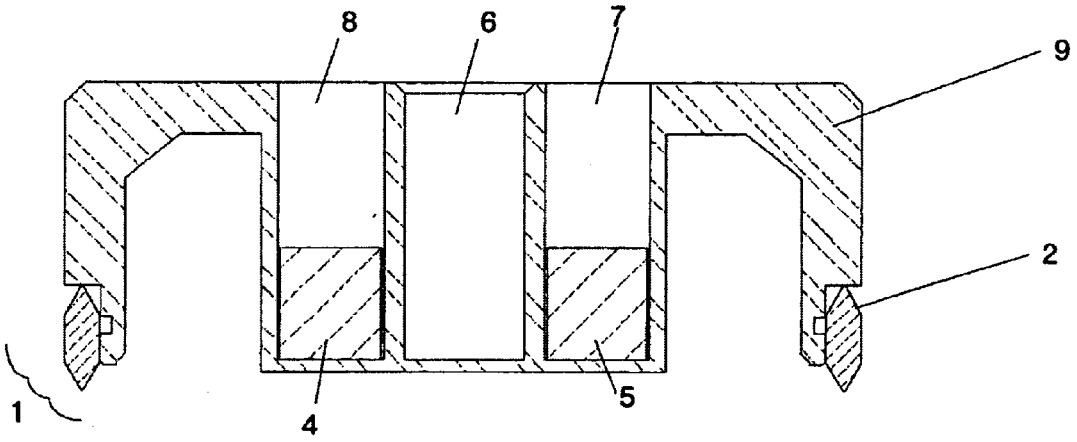
Figure 1 (PRIOR ART)
FIG. 1 is a prior art ink cup for an internal centering pin holddown machine.
Figure 2:
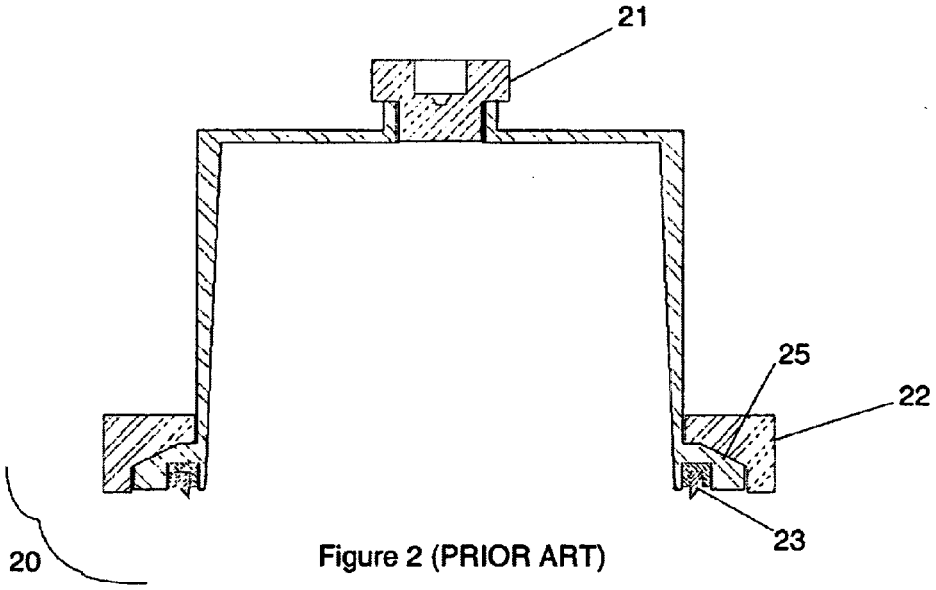
Figure 2 (PRIOR ART)
FIG. 2 is a prior art ink cup for an external holddown machine.
Figure 3:
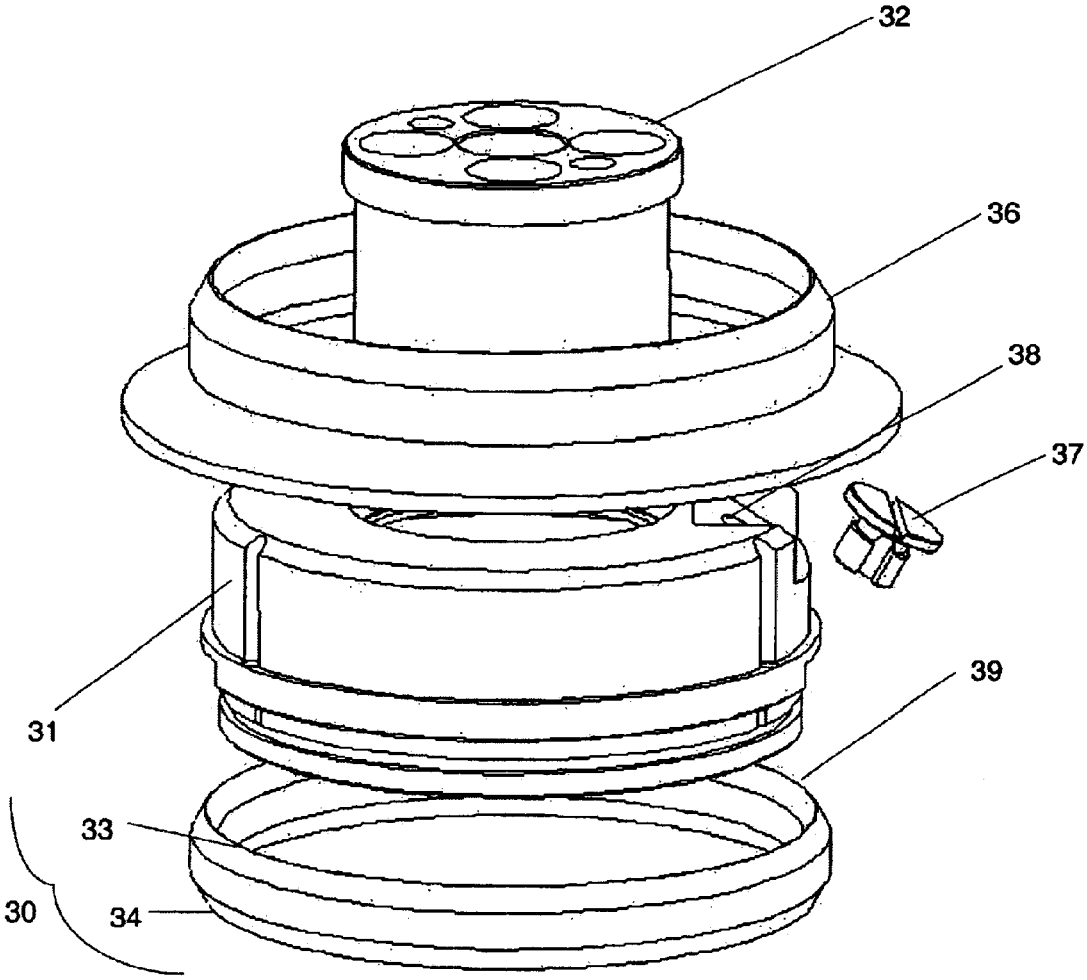
FIG. 3 is a universal ink cup in accordance with one embodiment of the invention.

A universal or generic ink cup is presented which is easily adaptable for use with a wide variety of pad printing machines. In accordance with one embodiment of the invention, the universal ink cup 30 includes a first cup 31 and a doctoring ring 39, as shown in FIG. 3. When moving universal ink cup 30 across a printing plate, first cup 31 holds ink, while doctoring ring 39, clears or doctors the excess ink from the smooth surface of the printing plate. In this manner, ink is left in depressions that were previously etched or otherwise placed into the plate, and which typically represent various symbols or logos.

To adapt universal ink cup 30 to a particular pad printing machine, various parts are easily added to or removed from ink cup 30. These parts include an exterior hold-down flange 36 for external holddown pad printing machines, and an engageable coupling 32 for internal centering pin holddown and magnetic-based pad printing machines. Depending on the type of pad printing machine the ink cup 30 is intended to be used on, and in particular, the method of affixing ink cup 30 to the machine, ink cup 30 is equipped by an operator with the appropriate part or parts. After the desired part or parts are in place, ink cup 30 is typically inverted and filled with a liquid, preferably an ink solution, and a printing plate is placed on top of ink cup 30 so that the engraved etch is facing the ink solution. After filling ink cup 30 with liquid, the whole assembly is inverted, so that ink cup 30 is now sitting on top of the printing plate and the liquid is trapped inside ink cup 30. The ink cup 30 is then affixed to the pad printing machine and moved across the printing plate. Depending on the type of pad printing machine and the ink cup 30 used, downward forces applied on ink cup 30 ensure a tight seal between doctoring ring 39 and the printing plate such that liquid is prevented from leaking out from underneath doctoring ring 39. As ink cup 30 is moved along the printing plate, doctoring ring 39 removes liquid deposited onto the smooth surface of the printing plate, while leaving liquid in the depressions on the plate. The ink cup 39 may then be detached from the pad printing machine and various removable parts replaced appropriately, so as to affix and use the ink cup 39 with the same or another pad printing machine using a different mounting scheme.

First cup 31 has walls that define a reservoir for holding liquid. The liquid is typically solvent based and contains a pigment. In preferred embodiments the liquid is printing ink. Both the size and shape of the first cup are variable. The perimeter of first cup 31 may be in the shape of, but not limited to, a circle, oval, or polygon. The diameter of first cup 31 is typically between the range of 30 to 250 mm. In preferred embodiments, first cup 31 includes an ink plug 37, which is removably coupled to first cup 31. Ink plug 37 allows for adding liquid to the first cup 31 without removing the ink cup from the printing plate and acts as a vent to relieve built up air and gases caused by the liquid. Typically, ink plug 37 screws into a hole 38 in the first cup 31.

The doctoring ring 39 is a precision component that may be made from, but not limited to, carbide steel, zirconia-based ceramic or polymer-based products. In preferred embodiments, doctoring ring 39 is removable and may be held in place with an O ring. Doctoring ring 39 may have two working edges, top 33 and bottom 34, thereby doubling the life of a single edged doctoring ring.

The engageable coupling 32 is removably coupled to first cup 31 and is interchangeable with other engageable couplings depending on what pad printing machine is utilized. In various embodiments, engageable coupling 32 is used to affix the ink cup 30 to the pad printing machine. The engageable coupling 32 may be in the form of a second cup; however, other forms may be utilized. Engageable coupling 32 and/or first cup 31 may be made of standard materials such as ceramics, metal, alloys, or polymers.

First cup 31 may include walls defining a hole such that engageable coupling 32 can be inserted into the hole and affixed to first cup 31. In this embodiment, if engageable coupling 32 is not required, such as when external mounting is implemented, engageable coupling 32 may simply act as a filler to prevent liquid from leaking out of the hole. Engageable coupling 32 and/or first cup 31 may include threads for affixing the first cup 31 to the engageable coupling 32. Alternatively, engageable coupling 32 may be bolted or screwed onto first cup 31.

Figure 4:
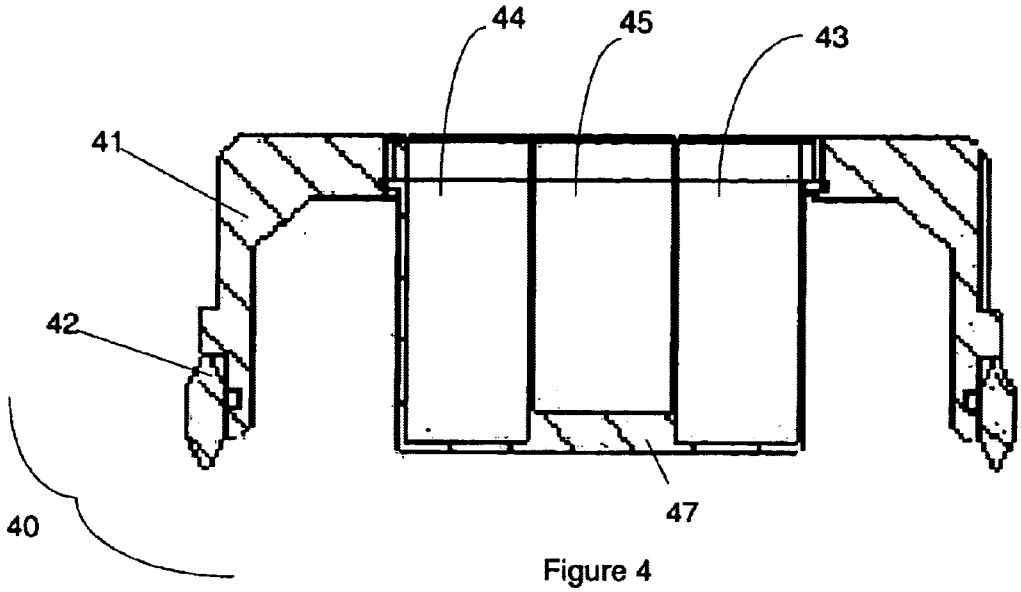
FIG. 4 is a cross-sectional view of a universal ink cup for an internal centering pin holddown machine in accordance with one embodiment of the invention.

In accordance with one embodiment of the invention, FIG. 4 is a cross-sectional view of a universal ink cup 40 for use, for example, in combination with internal centering pin holddown machines. Similar to FIG. 3, the engageable coupling 47 is in the shape of a second cup, and includes various types of walls for serving a variety of purposes. These purposes include, for example, affixing ink cup 40 to the pad printing machine, and inserting magnets into engageable coupling 47 so as to apply additional force for pressing the ink cup 40 against the printing plate. Engageable coupling 47 may include a cavity 45 that acts as a centering pin receptor for a pad printing machine. The shape of the cavity 45 can vary, and may be circular or polygonal in nature for example. The centering pin, which may include a spring plunger or air cylinder, enters the cavity and bottoms at the base of the hole 45. The centering pin may help press ink cup 40 against the printing plate, and is typically used in combination with magnets that further press ink cup 40 against the plate. Since the length and width of centering pins may vary, spacers may be inserted into receptor 45. Alternatively, engageable coupling 47 can be easily swapped with another engageable coupling that has a more appropriate pin receptor.

Figure 5:
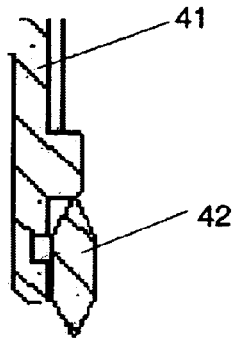
FIG. 5 is a detailed view of the doctoring ring shown in the cross-sectional view of the universal ink cup in FIG. 4, in accordance with one embodiment of the invention.

Engageable coupling 47 may include a number of cavities 43, 44 for inserting magnets. The magnets may or may not be used in conjunction with a centering pin. The magnets engage the printing plate with a magnetic force directed down towards the plate, to ensure a tight seal between doctoring ring 42, which is shown in more detail in FIG. 5, and the plate. In preferred embodiments, the cavities for holding magnets are oriented in such a manner that the magnetic force applied is evenly distributed around the perimeter of the doctoring ring 42. The magnet or magnets may each be permanently affixed in a cavity, with glue for example. Alternatively, the magnet may be temporarily inserted into the cavity.

Figure 6:
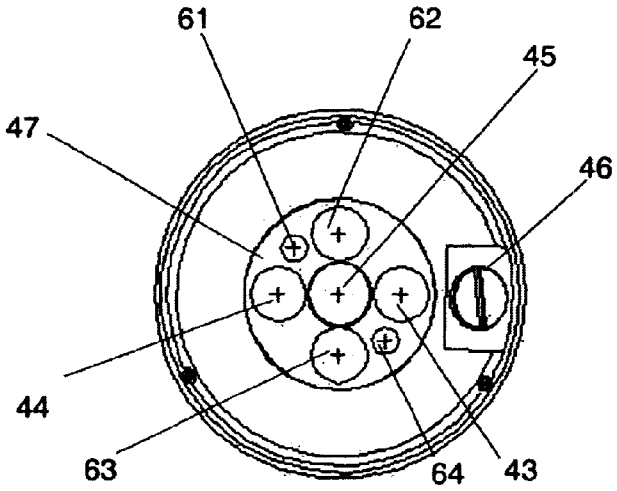
FIG. 6 is a top view of the universal ink cup shown in FIG. 4, in accordance with one embodiment of the invention.

FIG. 6 is a top view of the universal ink cup shown in FIG. 4. As can be seen in this view, engageable coupling 47 includes cavities 61, 64 for inserting a spanner wrench, to assist in inserting and removing the engageable coupling 47 to and from the first cup 41. The four cavities 43, 44, 62, and 63, are for holding magnets. Additionally, the first cup 41 includes an ink plug 46.

The engageable coupling may include any number and combination of cavities for the purposes of affixing the universal cup to the pad printing machine, utilizing magnets, or to assist in inserting or removing the engageable coupling from the first cup. It is also to be understood that the above embodiments are exemplary and other configurations are within the scope of the invention. For example, rather than cavities, other means for utilizing the engageable coupling so as to affix the first cup to the pad printing machine or to hold magnets may be utilized.

Figure 7:
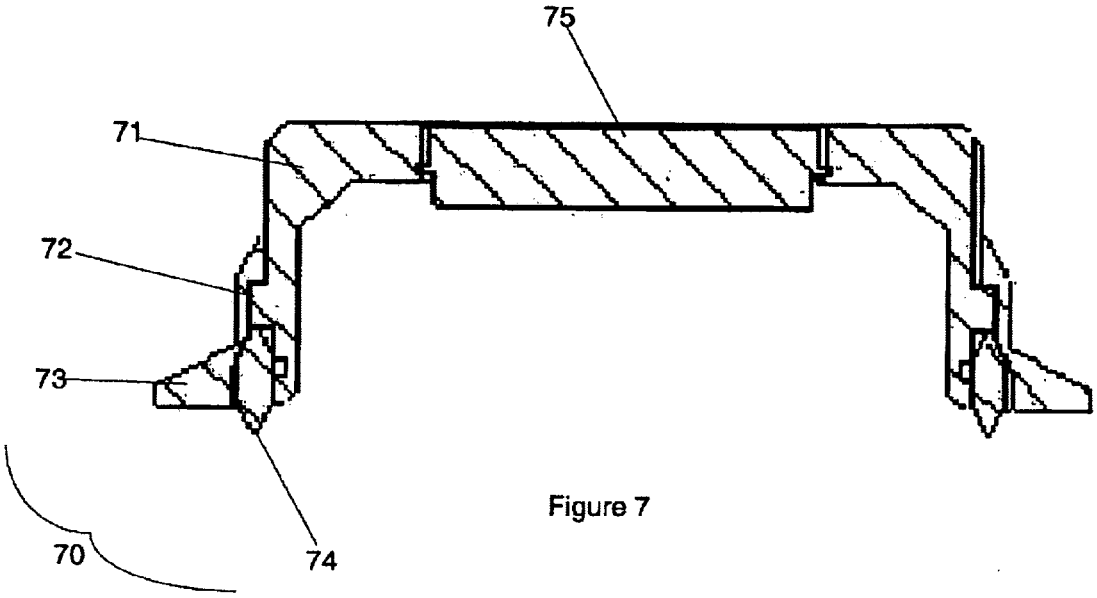
FIG. 7 is a cross-sectional view of a universal ink cup for an external holddown machine in accordance with one embodiment of the invention.
Figure 8:
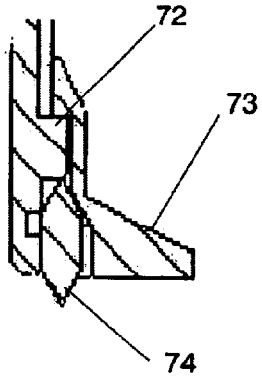
FIG. 8 is a detailed view of the external flange shown in the cross-sectional view of the universal ink cup in FIG. 7, in accordance with one embodiment of the invention.

In accordance with another embodiment of the invention, FIG. 7 is a universal ink cup 70 that has an extended shoulder 72 on the outside edge of the first cup 71 on which various types of flanges 73 can be dropped to accommodate exterior ink cup mounting. In preferred embodiments, the flange is non-magnetic. Extended shoulder 72, shown in more detail in FIG. 8, may be a continuous shoulder, which surrounds the outside perimeter of first cup 71. Alternatively, extended shoulder 72 may be discontinuous. The size and shape of the extended shoulder 72 can vary, and in accordance with one embodiment of the invention, is adjustable.

External flange 73 rests on shoulder 72. In various embodiments of the invention, external flange 73 is used in a manner so as to affix the external holddown machine to the universal cup 70. The external holddown machine may also apply downward pressure on external flange 73 to assist in creating a tight seal between the doctoring ring 74 and the printing plate. The size and shape of external flange 73 can vary, and may also be made adjustable.

In various embodiments, ink cup 70 includes both a shoulder 72 to accommodate exterior ink cup mounting, and an engageable coupling 75 as discussed above, which may be utilized with internal centering pin holddown and magnetic-based pad printing machines. Alternatively, universal ink cup 70 may have either a shoulder or an engageable coupling. Instead of including a shoulder 72, external flange 73 may be removably coupled to first cup 71 by, but not limited to, bolting or screwing external flange 73 to first cup 71. External flange 73 may also include threads for affixing external flange 73 to first cup 71.

Figure 9:
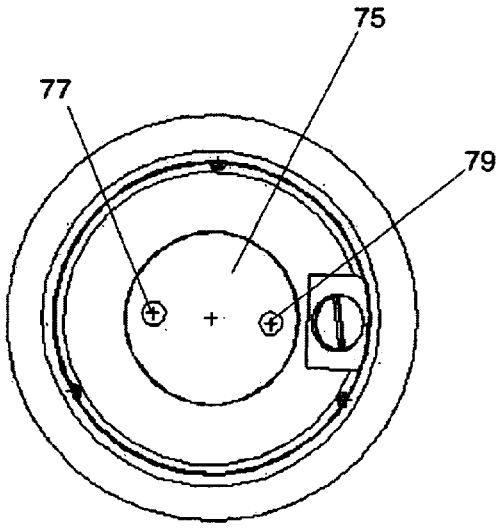
FIG. 9 is a top view of the universal ink cup shown in FIG. 7, in accordance with one embodiment of the invention.
Figure 10:
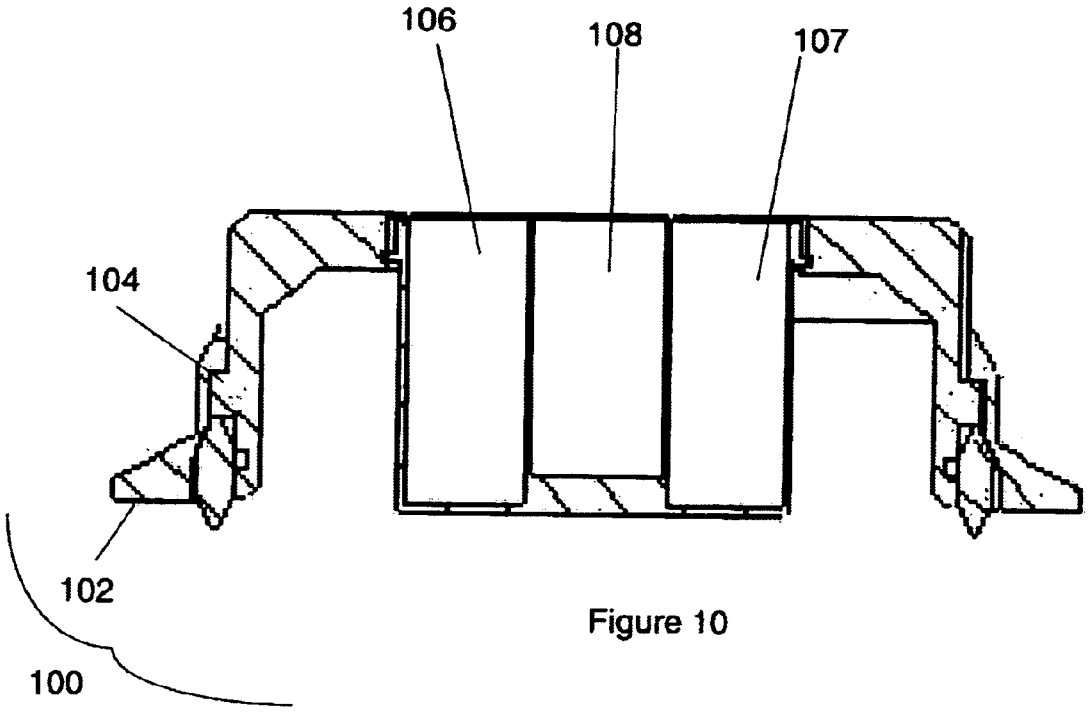
FIG. 10 is a cross-sectional view of a universal ink cup that includes both an external flange and an engageable coupling with receptacles for magnets and a centering pin, in accordance with one embodiment of the invention.

FIG. 9 shows a top view of the ink cup 70 depicted in FIG. 7. Engageable coupling 75 includes walls defining two cavities 77, 79 for inserting a spanner wrench so as to insert and remove engageable coupling 75. In this embodiment, engageable coupling 75 acts as a filler since an internal centering pin or magnet is not required. In alternative embodiments of the invention, as shown in FIG. 10, the universal ink cup 100 has an engageable coupling includes cavities for magnets 106, 107 and/or a centering pin centering pin receptor 108, in addition to having a shoulder 104 for use with an external flange 102.

While in one embodiment of the invention the universal ink cup is a stand-alone item, the universal ink cup can be integrated with other items as part of the machine. For example, the ink cup can be integrated with ink viscosity maintenance systems and solvent feeding systems to help keep the volume of ink inside the ink cup substantially constant.

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

What is claimed is:

1. A universal ink cup for a pad printing machine comprising:

a first cup having walls defining a reservoir for holding liquid;

a doctoring ring removably coupled to the first cup, the doctoring ring having a first working edge on a top surface of the doctoring ring and a second working edge on a bottom surface of the doctoring ring; and an engageable coupling removably coupled to both the first cup and the pad printing machine, the engageable coupling having walls defining a centering pin receptacle such that a centering pin of the pad printing machine can be inserted into the centering pin receptacle.

2. A universal ink cup according to claim 1, where the engageable coupling includes a second cup.

3. A universal ink cup according to claim 1, wherein the first cup includes walls defining a hole such that the engageable coupling can be inserted in the hole and affixed to the first cup.

4. A universal ink cup according to claim 1, wherein the first cup includes threads for affixing the first cup to the engageable coupling.

5. A universal ink cup according to claim 1 wherein the engageable coupling includes threads for affixing the engageable coupling to the first cup.

6. A universal ink cup according to claim 1, wherein the engageable coupling includes walls defining a cavity such that a magnet can be inserted into the cavity, the magnet for applying a magnetic force so as to press the ink cup against a printing plate.

7. A universal ink cup according to claim 1, wherein the engageable coupling includes walls defining a cavity for inserting a spanner wrench.

8. A universal ink cup according to claim 1, wherein the engageable coupling includes walls defining a cavity for inserting an antirotation pin.

9. A universal ink cup according to claim 1, further comprising an external flange coupled to the first cup, the external flange being non-magnetic.

10. A universal cup according to claim 9, wherein the external flange is removably coupled to the first cup.

11. A universal ink cup according to claim 10, wherein the external flange includes threads for affixing the external flange to the first cup.

12. A universal ink cup according to claim 10, further comprising means for bolting the external flange to the first cup.

13. A universal ink cup according to claim 10, further comprising means for screwing the external flange to the first cup.

14. A universal ink cup according to claim 1, wherein the first cup includes a support shoulder such that an exterior hold-down flange can be dropped onto the shoulder.

15. A universal ink cup according to claim 1, wherein the doctoring ring is formed of material selected from the group of materials consisting of ceramics, metals, alloys, and polymers.

16. A universal ink cup according to claim 1, further comprising an ink plug removably coupled to the first cup.

17. A universal ink cup according to claim 1, wherein the first cup is formed of material selected from the group of materials consisting of ceramics, metals, alloys, and polymers.

18. A universal ink cup according to claim 1, wherein the engageable coupling is formed of material selected from the group of materials consisting of ceramics, metals, alloys, and polymers.

19. A universal ink cup according to claim 1, wherein the first cup has an outer perimeter with a diameter range between 30 and 250 mm.

20. A universal ink cup according to claim 1, wherein the first cup has an outer perimeter defining a shape selected from the group of shapes consisting of a circle, oval, and polygon.

21. A universal ink cup for a pad printing machine comprising:

a first cup having walls defining a reservoir for holding liquid;

a doctoring ring removably coupled to the first cup the doctoring ring having a first working edge on a top surface of the doctoring ring and a second working edge on a bottom surface of the doctoring ring; and an external flange removably coupled to the first cup and the pad printing machine, the external flange being non-magnetic, wherein when the pad printing machine is affixed to the cup the pad printing machine contacts and applies pressure on the external flange.

22. A universal ink cup according to claim 21, wherein the first cup includes a support shoulder such that the flange is affixed to the first cup by dropping the flange onto the shoulder.

23. A universal ink cup according to claim 21, wherein the external flange includes threads for engaging the first cup.

24. A universal ink cup according to claim 21, further comprising means for screwing the external flange to the first cup.

25. A universal ink cup according to claim 21, further comprising means for bolting the external flange to the first cup.

26. A universal ink cup according to claim 21, wherein the doctoring ring is formed of material selected from the group of materials consisting of ceramics, metals, alloys, and polymers.

27. A universal ink cup according to claim 21, further comprising an ink plug removably coupled to the first cup for performing at least one operation from the group of operations consisting of adding ink to the first cup and venting the first cup.

28. A universal ink cup according to claim 21, wherein the first cup is formed of material selected from the group of materials consisting of ceramics, metals, alloys, and polymers.

29. A universal ink cup according to claim 21, wherein the first cup has an outer perimeter defining a circle with diameter range between 30 and 250 mm.

30. A universal ink cup according to claim 21, further comprising an engageable coupling coupled to the first cup, for affixing the universal ink cup to a pad printing machine.

31. A universal ink cup according to claim 30, wherein the engageable coupling includes a second cup.

32. A universal ink cup according to claim 30, wherein the engageable coupling is removably coupled to the first cup.

33. A universal ink cup according to claim 30, wherein the engageable coupling is removably coupled to the first cup and the pad printing machine, and wherein the engageable coupling includes walls defining a cavity such that a centering pin of the pad printing machine can be inserted into the cavity so as to affix the universal ink cup to the pad printing machine.

34. A universal ink cup according to claim 33, wherein the engageable coupling includes walls defining a cavity for inserting a magnet, the magnet for applying a magnetic force so as to press the ink cup against a printing plate.

35. A universal ink cup according to claim 21, wherein the first cup has an outer perimeter defining a shape selected from the group of shapes consisting of a circle, oval, and polygon.

36. A method for applying a liquid to a depression in a plate, the method comprising:

providing a cup having walls defining a reservoir for holding liquid;

removably attaching a first engageable coupling to the cup, the first engageable coupling having walls defining a first centering pin receptacle;

affixing the cup to a first pad printing machine via the first engageable coupling after the first engageable coupling has been removably attached to the cup, wherein affixing the cup includes inserting a first centering pin of the first pad printing machine into the first centering pin receptacle;

contacting the plate with the cup, wherein pressure supplied by the pad printing machine seals the cup against the plate;

moving the cup across the plate;

detaching the cup from the first pad Printing machine, wherein detaching the cup includes removing the first centering pin of the first pad Printing machine from the first centering pin receptacle;

removing the first engageable coupling from the cup;

removable attaching a second engageable coupling to the cup, the second engageable coupling having walls defining a second centering pin receptacle;

affixing the cup to a second pad printing machine via the second engageable coupling after the second engageable coupling has been removably attached to the cup, wherein affixing the cup includes inserting a second centering pin of the second pad printing machine into the second centering pin receptacle; and contacting the plate with the cup, wherein pressure supplied by the second pad printing machine seals the cup against the plate.

37. A method for applying a liquid to a depression in a plate, the method comprising:

providing a cup having walls defining a reservoir for holding liquid;

removably attaching a first external flange to the cup, the first external flange being non-magnetic;

affixing the cup to a first pad printing machine via the first external flange after the first external flange has been attached to the cup, wherein affixing the cup to the first pad printing machine includes contacting and applying pressure on the first external flange via the first pad printing machine;

contacting the plate with the cup;

moving the cup across the plate;

detaching the cup from the first pad printing machine;

removing the first external flange from the cup;

providing a second external flange removably coupled to the cup, the second external flange being non-magnetic;

affixing the cup to a second pad printing machine via the second external flange after the second external flange has been attached to the cup, wherein affixing the cup to the second pad printing machine includes contacting and applying pressure on the second external flange via the second pad printing machine; and contacting the plate with the cup.

38. A method for applying a liquid to depressions in a plurality of plates, the method comprising:

providing a cup having walls defining a reservoir for holding liquid;

removably attaching a first engageable coupling to the cup;

affixing the cup to a first pad printing machine via the first engageable coupling;

contacting a first plate with the cup, wherein pressure supplied by the first pad printing machine seals the cup against the first plate;

moving the cup across the first plate;

detaching the cup from the first pad printing machine;

removing the first engageable coupling from the cup;

removably attaching a second engageable coupling to the cup;

affixing the cup to a second pad printing machine via the second engageable coupling;

contacting a second plate with the cup, wherein pressure supplied by the second pad printing machine seals the cup against the second plate; and moving the cup across the second plate, wherein the second pad printing machine is incompatible with the first engageable coupling.

39. The method according to claim 38, wherein the first engageable coupling has walls defining a first centering pin receptacle and the second engageable coupling has walls defining a second centering pin receptacle, wherein affixing the cup to the first pad printing includes inserting a first centering pin of the first pad printing machine into the first centering pin receptacle, wherein affixing the cup to the second pad printing includes inserting a second centering pin of the second pad printing machine into the second centering pin receptacle, and wherein the second centering pin is incompatible with the first centering pin receptacle.

40. A method for applying liquid to depressions in a plurality of plates, the method comprising:

providing a cup having walls defining a reservoir for holding liquid;

removably coupling a first external flange to the cup, the first external flange being non-magnetic;

affixing the cup to a first pad printing machine via the first external flange;

contacting a first plate with the cup;

moving the cup across the first plate;

detaching the cup from the first pad printing machine;

removing the first external flange from the cup;

removably coupling a second external flange to the cup, the second external flange being non-magnetic;

affixing the cup to a second pad printing machine via the second external flange; and contacting a second plate with the cup, wherein the second pad printing machine is incompatible with the first external flange.

41. A method for applying liquid to depressions in a plurality of plates, the method comprising:

providing a cup having walls defining a reservoir for holding liquid;

removably attaching an engageable coupling to the cup, the engageable coupling having walls defining a centering pin receptacle;

affixing the cup to a first pad printing machine via the engageable coupling, wherein affixing the cup to the first pad printing includes inserting a centering pin of the first pad printing machine into the centering pin receptacle;

contacting a first plate with the cup, wherein pressure supplied by the pad printing machine seals the cup against the first plate;

moving the cup across the first plate;

detaching the cup from the first pad printing machine;

removing the engageable coupling from the cup;

removably attaching an external flange to the cup;

affixing the cup to a second pad printing machine via the external flange;

contacting a second plate with the cup, wherein pressure supplied by the second pad printing machine seals the cup against the second plate; and moving the cup across the second plate wherein the second pad printing machine is incompatible with the engageable coupling.

* * * * *